US005417157A

United States Patent [19]

Köbler

[11] Patent Number: 5,417,157

[45] Date of Patent: May 23, 1995

[54] PAIR OF WEB PULLING CYLINDERS IN PRINTING MACHINES

[75] Inventor: Ingo Köbler, Anhausen, Germany

[73] Assignee: MAN Roland Druckmaschinen AG, Offenbach, Germany

[21] Appl. No.: 234,588

[22] Filed: Apr. 28, 1994

Related U.S. Application Data

[63] Continuation of Ser. No. 41,710, Apr. 1, 1993, abandoned.

[30] Foreign Application Priority Data

Apr. 1, 1992 [DE] Germany ..... 42 10 777.6

[51] Int. Cl.[6] ..... B41F 13/54

[52] U.S. Cl. ..... 101/228; 101/DIG. 42

[58] Field of Search ..... 101/216, 219, 228, 232, 101/DIG. 42; 226/181, 182, 188

[56] References Cited

U.S. PATENT DOCUMENTS

| | | | |
|---|---|---|---|
| 3,905,533 | 9/1975 | Corse | 101/228 |
| 3,906,809 | 9/1975 | Erickson | 74/192 |
| 3,995,551 | 12/1976 | Mitter | 101/228 |
| 4,785,734 | 11/1988 | Kawana et al. | 101/219 |

FOREIGN PATENT DOCUMENTS

| | | | |
|---|---|---|---|
| 0267007A2 | 3/1987 | European Pat. Off. . | |
| 2550995 | 3/1985 | France . | |
| 65501 | 12/1891 | Germany . | |
| 864021 | 7/1949 | Germany . | |
| 2108026 | 2/1971 | Germany . | |
| 2421841 | 5/1974 | Germany | F16H 15/52 |

*Primary Examiner*—Ren Yan

*Attorney, Agent, or Firm*—Cohen, Pontani, Lieberman, Pavane

[57] ABSTRACT

A pair of web pulling cylinders, particularly for use in printing machines, wherein a single-layer or multiple-layer web is conveyed between the cylinders which are pressed together. The cylinders are driven and are in driven connection through drive elements mounted on cylinder journals. If the web is deflected around one of the cylinders, a differential gear unit is provided to adapt the circumferential speeds of the cylinders to the thickness of the web being pulled.

5 Claims, 3 Drawing Sheets

PAIR OF WEB PULLING CYLINDERS IN PRINTING MACHINES

This is a continuation of U.S. application Ser. No. 08/041,710, filed Apr. 1, 1993, now abandoned.

BACKGROUND OF THE INVENTION

1. Field of the Invention

The present invention relates to a pair of web pulling cylinders, particularly for use in printing machines. A single-layer or multiple-layer web is conveyed between the cylinders which are pressed together. The cylinders are driven and are in driven connection through drive elements mounted on the cylinder journals.

2. Description of the Related Art

German Patent 65 501 discloses a pair of pulling cylinders, wherein the cylinders are driven and are in driven connection through spur wheels mounted on the cylinder journals. The web is guided in a straight line through the cylinders which are adjusted relative to each other. If the web were simultaneously deflected or guided around one of the cylinders, when the web travels around the cylinder the speed increases on the upper side of the web which is guided around the cylinder corresponding to the increase of the radius resulting from the thickness of the web. The increase of the speed on the upper side of the web becomes greater as the number of the layers of the web increases. The speed difference relative to the second cylinder of the pair of pulling cylinders which rotates with unchanged web speed leads to the formation of creases and to displacement of the layers of the web. As a consequence, smearing of the print occurs within the layers of the web as well as on the surface thereof. In addition, the outer surfaces of the web become damaged because of a scratching effect of the rough outer surfaces of the cylinders.

SUMMARY OF THE INVENTION

Therefore, it is the primary object of the present invention to provide a pair of web pulling cylinders, wherein the circumferential speed of the cylinders is adapted to the thickness of the web being pulled.

In accordance with the present invention, the driven connection of the cylinders includes an accomodating gear unit.

An accomodating gear unit according to the present invention provides that the speed of the outer side of the web guided around one of the cylinders of the pair of web pulling cylinders and the circumferential speed of the cylinder contacting the outer side of the web coincide independently of the thickness of the web. This prevents the formation of creases and the displacement of the layers of the web. In addition, smearing of the printing ink and damage of the outer surfaces of the web are prevented.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

DESCRIPTION OF THE PREFERRED EMBODIMENTS

Figure 1:
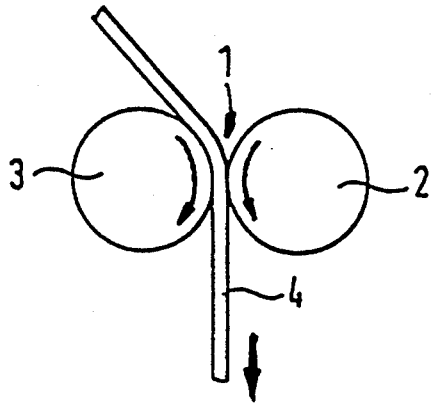
FIG. 1 is a schematic side view of a pair of web pulling cylinders.

FIG. 1 shows a pair 1 of web pulling cylinders 2 and 3 and a multiple-layer web 4 which is conveyed between the cylinders 2 and 3.

Figure 2:
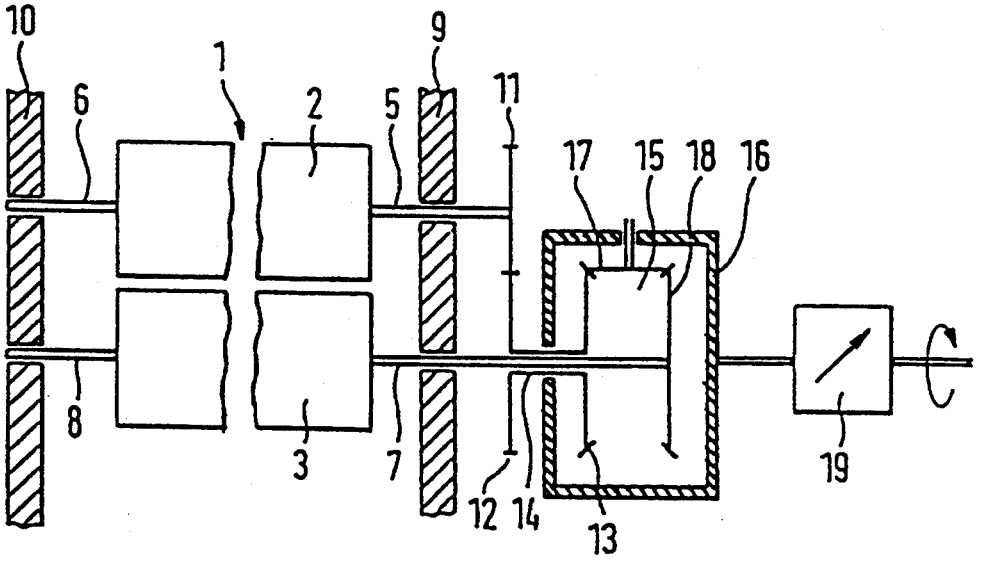
FIG. 2 is a schematic front view of the pair of web pulling cylinders of FIG. 1 driven by planetary bevel gear unit.

As shown in FIG. 2, the cylinders 2, 3 are mounted with cylinder journals 5, 6, 7 and 8 in side walls 9, 10. A spur wheel 11 is attached to the cylinder journal 5 and a double wheel 14 including a spur wheel 12 and a bevel wheel 13 is rotatably mounted on the cylinder journal 7. The bevel wheel 13 is a component of a planetary bevel gear unit 15 and is in driven connection with a bevel wheel 18 through an intermediate wheel 17 mounted in the housing 16. The bevel wheel 18 is attached to the cylinder journal 7. The housing 16 is driven, for example, by the longitudinal shaft of the printing machine with the intermediate arrangement of a gear unit having an infinitely variable transmission ratio, i.e., a so-called variator 19.

For driving the pair 1 of web pulling cylinders, initially the housing 16 of the planetary bevel gear unit 15 is driven by the variator 19. The housing 16 drives the bevel wheels 13 and 18 through the intermediate wheel 17. The bevel wheel 18 drives the cylinder 3 and the bevel wheel 13 drives the cylinder 2 through spur wheels 12 and 11. The circumferential speeds of the cylinders 1 and 2 are automatically adapted to the speeds of the upper side and the lower side of the web 4 by means of the intermediate wheel 17 which rotates about its own axis. The conveying speed of the pair 1 of web pulling cylinders can be varied by means of the variator 19 to obtain a desired tension of the web.

The spacing between the cylinders 2 and 3 is adjustable in accordance with the thickness of the web. However, the means for adjusting the spacing are not described in detail herein because the present invention is not directed to this adjustment and solutions for adjusting the spacing are well known in the art. It should only be mentioned that, in the illustrated embodiment, it is possible to provide an elastic, torque-transmitting mounting of the cylinder shells on the axes of the cylinders. On the other hand, it is also possible to construct the gear wheels 11, 12 as intermediate wheels which are in engagement with gear wheels of the cylinder journals, wherein one cylinder is pivotally mounted in levers about its drive gear wheel.

For driving a pair of web pulling cylinders, it is also within the scope of the present invention to use other types of planetary bevel gear units or planetary spur gear units or differential gears of the harmonic-drive-type. Thus, the axis of rotation of the housing of a planetary bevel gear unit may extend perpendicularly to the longitudinal axes of the cylinder journals of the pair of web pulling cylinders and the driven shafts of the gear unit located in the axis of rotation drive bevel wheels of the cylinder journals of the pair of cylinders through bevel wheels.

When a planetary spur gear unit is used, the driven gear wheels which are in driven connection with the cylinder journals are advantageously constructed as sun wheels with internal toothing. The drive member of this gear unit is a web member which supports two planetary wheels which are in engagement with each other, wherein each planetary wheel meshes with a sun wheel.

If a differential gear unit of the harmonic-drive-type is used, the circular spline and the dynamic spline are advantageously each in driven connection with a cylinder journal, wherein, for example, the circular spline is fastened directly on the cylinder journal and the dynamic spline drives a gear wheel of the other cylinder journal with the intermediate arrangement of a gear wheel. The drive is effected by the wave generator.

Figure 3:
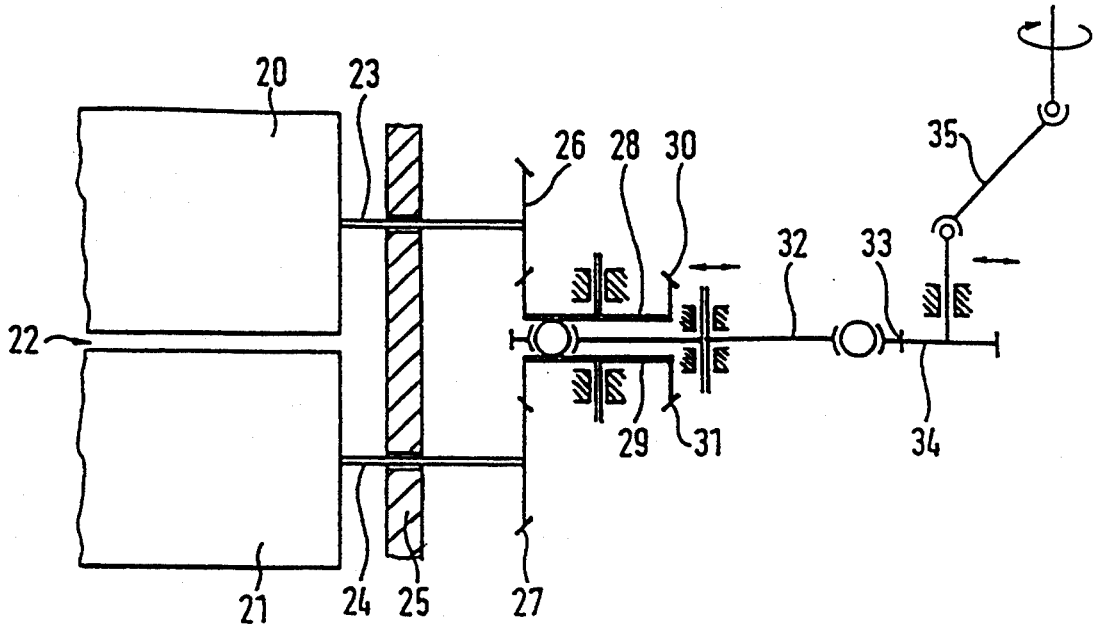
FIG. 3 is a partial view of a pair of web pulling cylinders, on a larger scale, with another differential gear unit.

As illustrated in FIG. 3, the cylinders 20, 21 of a pair 22 of web pulling cylinders are mounted with their cylinder journals 23, 24 in side walls 25. Each of the cylinder journals 23, 24 is connected to a bevel wheel 26. 27 which are in respective engagement with bevel wheels 30, 31 fastened on disks 28, 29 which are rotatably mounted in a frame. The disks 28, 29 extend parallel to each other and are spaced from each other. A ball race 32 which contacts both disks 28, 29 is located in the gap formed between the disks 28, 29. The ball race 32 has a toothed rim 33 and is displaceable in radial direction of the disks 28, 29. The toothed rim 33 is in meshed engagement with a pinion 34 which is displaceable together with the ball race 32. The pinion 34 is driven through a universal joint shaft 35 by means of, for example, the principal shaft of the printing machine.

The pinion 34 rotates the ball race 32 through the toothed rim 33. The balls of the ball race 32 drive the disks 28, 29 through frictional engagement therewith. The disks 28, 29, in turn, drive the cylinders 20 and 21 through the bevel wheels 30, 26 and 31, 27. In order to automatically obtain the required differences in the rate of rotation of the cylinders 20, 21, the balls of the ball race 32 facilitate the required relative rotation by rolling movements in circumferential direction of the disks 28, 29. The drive for the web pulling cylinders does not require a special variator for changing the conveying speed of the pair 22 of web pulling cylinders. A displacement of the ball race 32 changes the drive radius at the disks 28, 29 and, thus, the transmission ratio of the gear unit.

Figure 4:
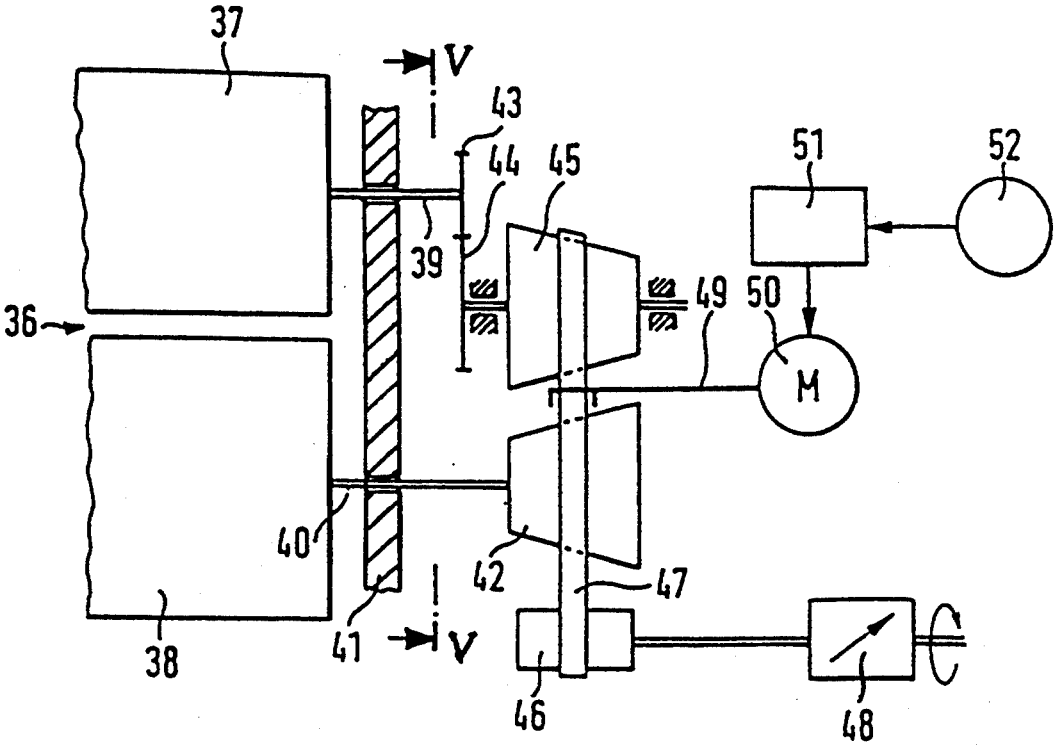
FIG. 4 is a view similar to FIG. 3 with another type of differential gear unit.
Figure 5:
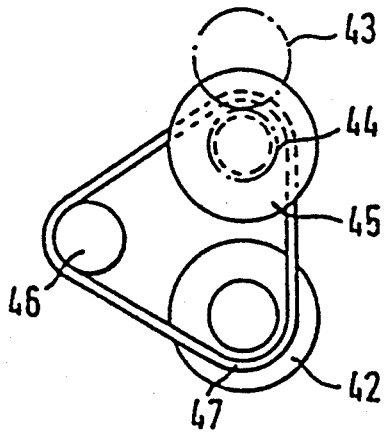
FIG. 5 is a sectional view taken along sectional line V—V of FIG. 4.

FIG. 4 of the drawing shows the drive of a pair 36 of web pulling cylinders, wherein the drive is a belt drive with conical rollers. The web pulling cylinders 37, 38 of the pair 36 are mounted with cylinder journals 39, 40 in side walls 41. A conical roller 42 is mounted on the cylinder journal 40 and a gear wheel 43 is fastened to the cylinder journal 39. The gear wheel 43 is in driven connection with a conical roller 45 through a gear wheel 44. The conical rollers 42 and 45 as well as a drive roller 46 are in driven connection through an endless belt 47, as illustrated in FIG. 5. The drive roller 46 is driven by a variator 48. The belt 47 is laterally displaceable by means of a forked member 49 which is driven by a motor 50. The motor 50 is connected to a control device 51 which is supplied with signals from a web thickness pick-up 52.

The drive roller 46 driven by the variator 48 drives the conical rollers 42 and 45 by means of the belt 47. The conical roller 42 drives the cylinder 38 directly and the conical roller 45 drives the cylinder 37 through the gear wheels 44 and 43. For adapting the cylinder speeds to the speeds of the web, the motor 50 laterally displaces the belt 47 by means of the forked member 49. For example, when the belt 47 is displaced toward the right as seen in the drawing, the circumferential speed of the cylinder 38 is reduced and the circumferential speed of the cylinder 37 is increased. The displacement of the belt 47 is effected by means of motor 50 which is controlled by the control device 51. For this purpose, a signal of the pick-up 52 which represents the web thickness is supplied to the control device 51. The signal may also provide, for example, a stored program control in accordance with data for a specific order. The adjustment of the speed of the pair of web pulling cylinders is effected by means of the variator 48.

Figure 6:
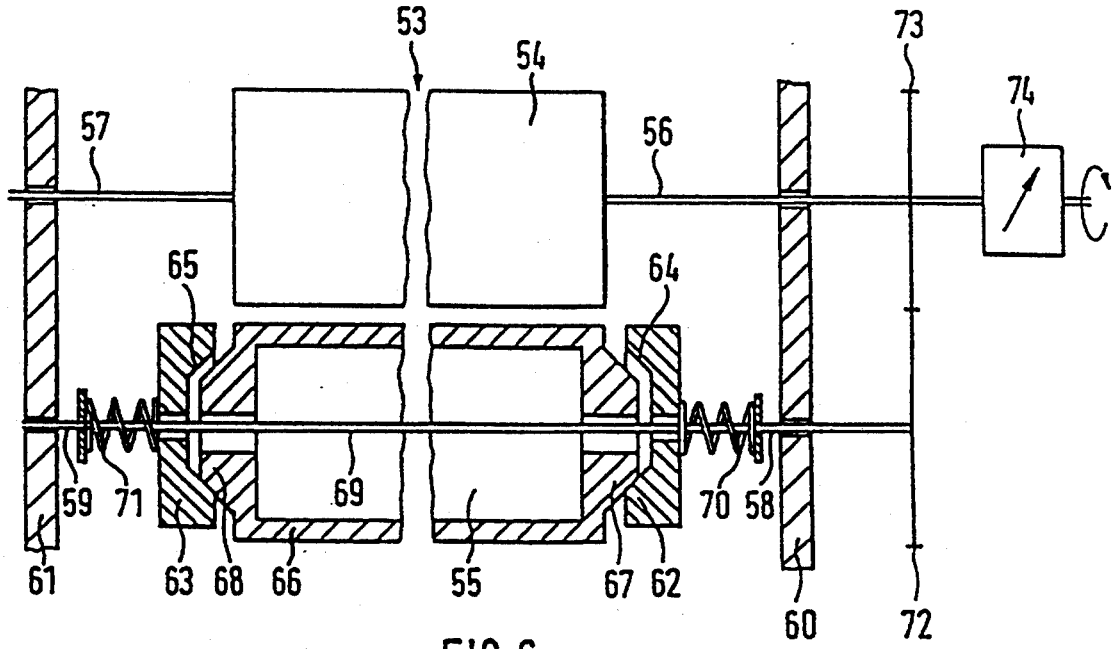
FIG. 6 is a view similar to FIG. 2 of another embodiment of the invention.

FIG. 6 of the drawing shows a pair 53 of web pulling cylinders 54 and 55 whose cylinder journals 56 to 59 are mounted in the side walls 60 and 61. Each cylinder journal 58 and 59 of the cylinder 55 has a lateral disk 62, 63 which is slidable on the cylinder journal and is provided with an inner taper 64, 65. An outer taper 67, 68 at the ends of the cylinder shell 66 of the cylinder 55 projects into one of the inner tapers 64, 65. The cylinder shell 66 is rotatably and radially displaceably mounted on the shaft 69 of the cylinder 55. A pressure is applied in the direction of the cylinder shell 66 against the side disks or members 62, 63 by means of compression springs 70, 71. The cylinder journal 58 supports a spur wheel 72 which is in engagement with a spur wheel 73 on the cylinder journal 56. The cylinder journal 56 is in driven connection with a variator 74.

The pair 53 of web pulling cylinders is driven, for example, by the principal shaft of the printing machine through the variator 74. The drive of the cylinder 54 is effected through the cylinder journal 56, and the drive of the cylinder 55 is effected through the gear wheels 73 and 72 and the cylinder journals 58, 59. The lateral disks 62 and 63 rotate together with the cylinder journals 58, 59. The inner tapers 64, 65 of the lateral disks 62 and 63 are in frictional engagement with the outer tapers 67, 68 and, thus, drive the cylinder shell 66 of the cylinder 55. In case of a greater thickness of the webs, the cylinder shell 66 is spaced at a greater distance from the cylinder 54. This is effected by laterally displacing the side members 62, 63 away from the cylinder shell 66 as a consequence of the axial force component in the zone of contact of the inner and outer tapers 64, 65, 67, 68. As a result, the zone of contact of the inner tapers 64, 65 is shifted to a greater diameter portion and in the outer tapers 67, 68 the zone of contact is shifted to a smaller diameter portion. This increases the circumferential speed of the cylinder shell 66 and the circumferential speed is automatically adapted to the increased speed of the surface of the web guided around the cylinder 54. A change of the speed of the pair 53 of web pulling cylinders is effected by means of the variator 74.

It should be understood that the preferred embodiments and examples described are for illustrative purposes only and are not to be construed as limiting the scope of the present invention which is properly delineated only in the appended claims.

I claim:

1. A pair of web pulling cylinders in a printing machine for conveying a web therebetween, comprising:

means for pressing the cylinders against each other, each cylinder having a cylinder journal and a drive element mounted on the cylinder journal; drive means for driving the cylinders through the drive elements; and an accommodating gear unit connected to said drive elements, said accommodating gear unit being provided as a differential gear unit mounted between the drive elements of the cylinder journals and the drive means so as to maintain a rotational speed differential between the pair of web pulling cylinders, said differential gear unit having a single input connected to said drive means and two outputs, each one of the two outputs of the differential gear unit being respectively connected to the drive element of one of the cylinder journals.

2. The pair of web pulling cylinders according to claim 1, wherein the drive means for the web pulling cylinders is a drive with variable rate of rotation.

3. The pair of web pulling cylinders according to claim 1, wherein the differential gear unit is a planetary bevel gear unit connected to the drive elements of the cylinder journals.

4. The pair of web pulling cylinders according to claim 1, wherein the differential gear unit is a planetary spur gear unit connected to the drive elements of the cylinder journals.

5. The pair of web pulling cylinders according to claim 1, wherein the differential gear unit is a gear of the harmonic-drive-type unit connected to the drive elements of the cylinder journals.

* * * * *